United States Patent [19]

Peisner et al.

[11] 4,265,183

[45] May 5, 1981

[54] UPPER CLOSURE FOR AN END DOOR OF A RAIL CAR

[75] Inventors: Israel D. Peisner, Huntington Woods; George H. Stol, Berkley, both of Mich.

[73] Assignee: Whitehead & Kales Company, River Rouge, Mich.

[21] Appl. No.: 87,405

[22] Filed: Oct. 22, 1979

[51] Int. Cl.[3] ..... B61D 17/06; B61D 19/00

[52] U.S. Cl. ..... 105/410; 49/41

[58] Field of Search ..... 105/404, 410, 423, 378, 105/379, 339; 49/102, 40, 41

[56] References Cited

U.S. PATENT DOCUMENTS 3,977,123 8/1976 Clay, Jr. et al. ..... 105/410

4,077,330 3/1978 Peisner et al. ..... 105/410

*Primary Examiner*—Richard A. Bertsch

*Attorney, Agent, or Firm*—Whittemore, Hulbert & Belknap

[57] ABSTRACT

An end closure for a rail car which comprises a pair of doors mounted for lateral movement from a closed position across the major lower portion of the opening in one end of the rail car to an open position. A panel is mounted above each door for lateral movement from a closed position across an upper portion of the opening in the end of the rail car to an open position. Each panel is connected to the door beneath it to cause the panel to be moved to open and closed positions by the corresponding movement of the door.

8 Claims, 6 Drawing Figures

UPPER CLOSURE FOR AN END DOOR OF A RAIL CAR

This invention relates generally to rail cars and refers more particularly to an end closure for a rail car.

The general object of this invention is to provide an end closure for a rail car which will protect the car from illegal or unauthorized entry and which will protect the contents of the car from flying objects.

End closures of this general type are shown in the prior U.S. Pat. of D. J. Blunden, No. 3,995,563 and of Israel D. Peisner and Paul J. Ye, U.S. Pat. No. 4,077,330, both assigned to the assignee of this application. Each such prior patent discloses an end closure which comprises two sliding doors mounted for movement between closed and open positions. When closed, such doors extend across the open end of the rail car and close all but a minor portion of the opening in the end of the rail car between the tops of the doors and the roof contour. When opened, each door preferably moves into an open space on the outer side of the rail car within the allowed rail car side clearance, where it does not reduce the loading capacity of the rail car.

The principle object of this invention is to provide an improvement in the end closure construction disclosed in such prior patents by providing means to close the minor portion of the opening above the doors and to this end, a panel is provided above each door. The panels in the construction about to be described are mounted above the doors for lateral movement between closed and open positions, and means connecting each panel to the door beneath causes the panel to be moved to open and closed positions simultaneously with the corresponding movement of the door. When opened, each panel preferably moves inside the rail car within the roof line. If the panels opened to positions outside the rail car, as the doors do, there would be the risk that they might be beyond the allowed lateral limit.

A further object is to provide a special hinged panel construction designed to follow a path clear of the lading.

BRIEF DESCRIPTION OF THE DRAWINGS:

Other objects and advantages of this invention will be apparent as the following description proceeds, especially when considered with reference to the accompanying drawings wherein.

DETAILED DESCRIPTION

Referring now more particularly to the drawings, the rail car is generally designated R and is shown as having the elongated longitudinally extending decks A1, A2, A3 which in this instance are especially adapted for the transport of road vehicles.

Figure 1:
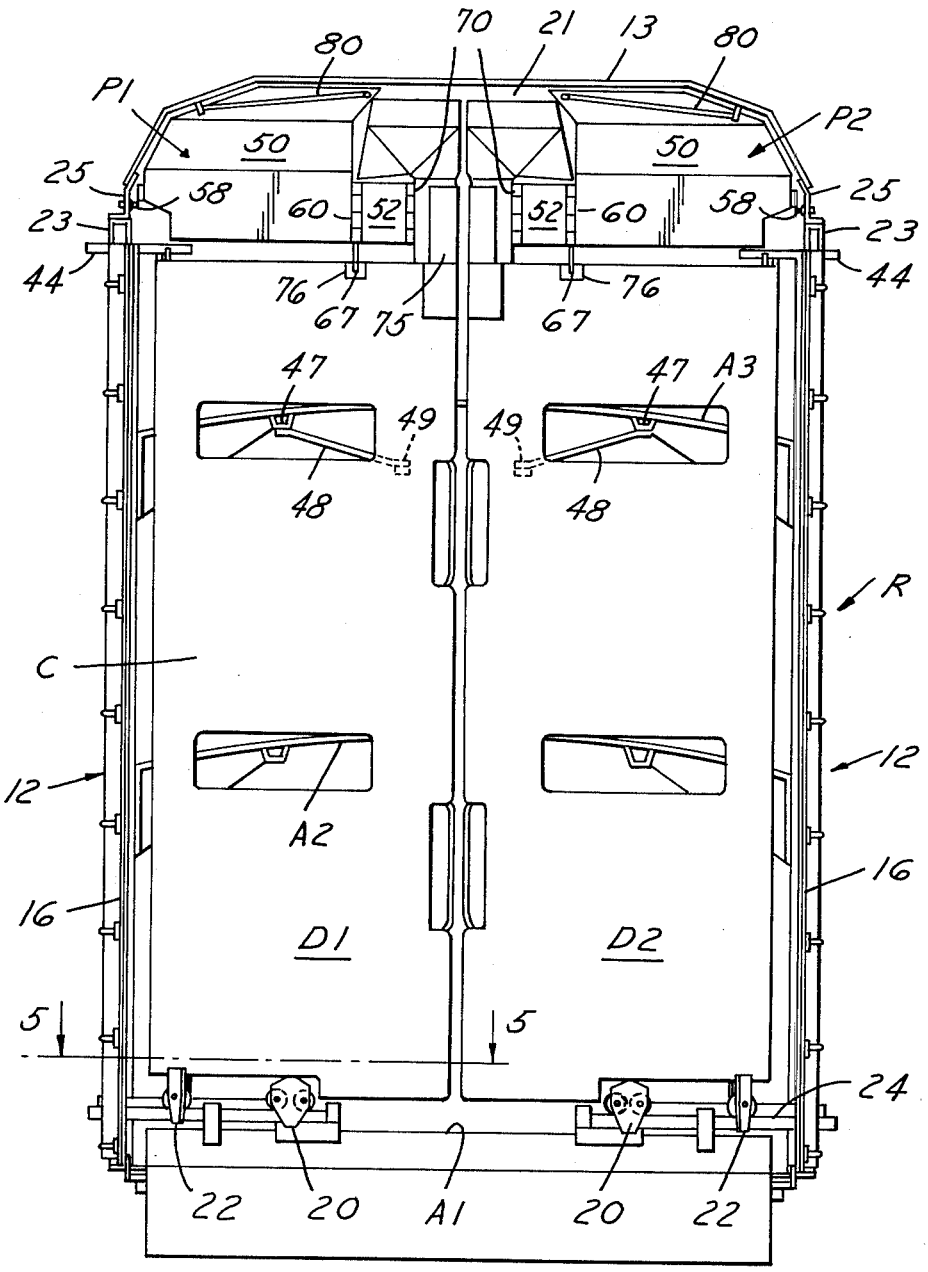
FIG. 1 is an end view of a rail car having an end closure constructed in accordance with this invention.
Figure 6:
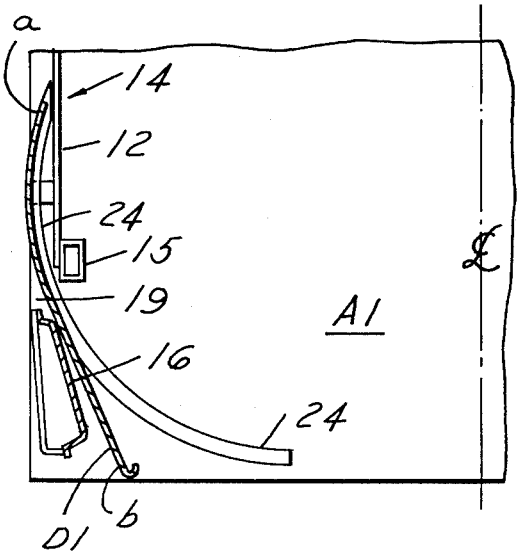
FIG. 6 is similar to FIG. 5, but shows the door in open position.
Figure 5:
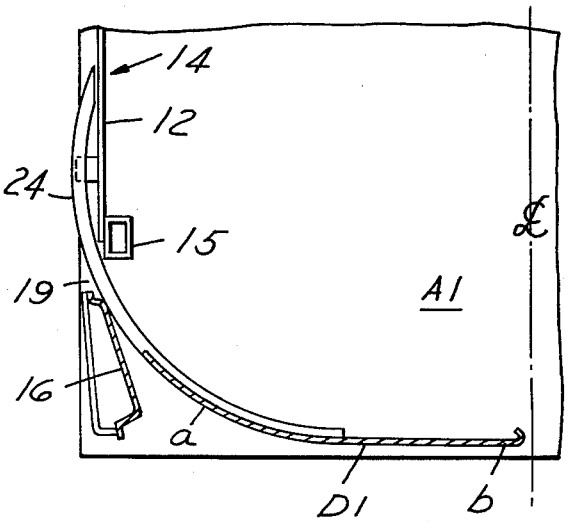
FIG. 5 is a fragmentary sectional view taken on the line 5—5 in FIG. 1, showing a door in closed position.

The rail car has the side walls 12 and is preferably closed at the top by the roof 13 and is open at least at the end shown in FIG. 1. The main portion 14 of each side wall terminates in a vertical edge portion provided with an upright pillar or post 15 located a short distance from the end of the rail car. Each side wall also has an upright member 16 positioned beyond the main portion 14 which in this case has rungs to enable a workman to climb to the decks A2 and A3. Each member 16 is spaced laterally outwardly and forwardly of the main portion 14 of the side wall, as will be apparent in FIGS. 5 and 6, and cooperates with the posts 15 of the main portion 14 in defining a vertically extending slot or gap 19. The slot or gap 19 in each side wall 12 provides an opening for the path of one of the doors of the end closure about to be described.

The end closure for one end of the rail car is generally designated C and comprises two doors D1 and D2 and two panels P1 and P2. The doors D1 and D2 are disposed on opposite sides of the center line of the rail car and, when closed, each is adapted to extend across approximately one-half the width of the rail car so that together the two doors provide substantially a complete end closure, except for that portion of the opening in the end of the rail car above the doors, designated 21. Such portion 21 of the opening above the doors is defined by the roof 13, the horizontal, longitudinally extending beams 23 and upper side wall section 25. As shown, the side edge portions of the roof 13 slope downwardly and are mounted on the upper side wall sections 25 which are mounted on the beams 23 supported on the tops of the main portions 14 and the side walls 12. The upper portion 21 of the opening above the doors is closed by the two panels P1 and p2, as will become apparent hereinafter.

The doors D1 and D2 are mirror images of one another so that a description of one will suffice for both. The door D1 is a vertical member having the configuration shown in FIGS. 5 and 6. The door D1 has an arcuate laterally outer portion a and a straight laterally inner portion b which is tangent to the arc of the outer portion a. It is supported for sliding or rolling movement from the closed position shown in FIGS. 1 and 5 to the open position shown in FIG. 6. When the doors are closed, the straight portions b lie in a common plane at right angles to the longitudinal center line of the rail car.

The lower edge portion of the door D1 is supported by roller assemblies 20 and 22 upon the track 24 which may be of the same arcuate form as the portion a of the door. The track 24 is mounted on the deck A1 in the corner of the rail car and extends through the gap 19 in the side wall 12 so that a portion thereof is on the outer side of the side wall 12. The roller assemblies may be of any suitable construction such, for example, as that shown in either of the two patents referred to above.

The upper edge of the door is guided by a guide 44 which is secured to the rail car above deck A3 and which may be of the same arcuate form as the portion a of the door. Guide 44 is directly above track 24 and may be of inverted angle shape to receive and guide the spaced fingers 46 which are secured to and project upwardly from the upper edge of the door along opposite sides of the vertical flange of guide 44.

To further support and guide the upper edge portion of the door during its movement between open and closed positions, an arm 48 has one end pivoted at 47 to the underside of the deck A3 and is pivoted at the opposite end to a bracket 49 on the door. Pivot 47 is located at the center of the arc of the track 24.

Any suitable locking mechanism, such as that disclosed in either of the two patents referred to hereinabove, may be employed to lock the doors D1 and D2 in thier closed and open positions.

The panels P1 and P2 are mirror images of one another so that a description of one will suffice for both. Panel P1 is mounted directly above door D1 and panel P2 is mounted directly above door D2. Panel P1 comprises an outer section 50 and an inner section 52. The outer edge portion of the outer panel section 50 is pivotally mounted on a vertical hinge pin 54 which is secured to a sleeve 56. Sleeve 56 slides on the horizontal longitudinally extending rod 58 secured to the inner side of the side wall section 25.

The panel section 50 and 52 are hinged together on a vertical hinge 60 which has a vertical hinge pin 66.

Figure 2:
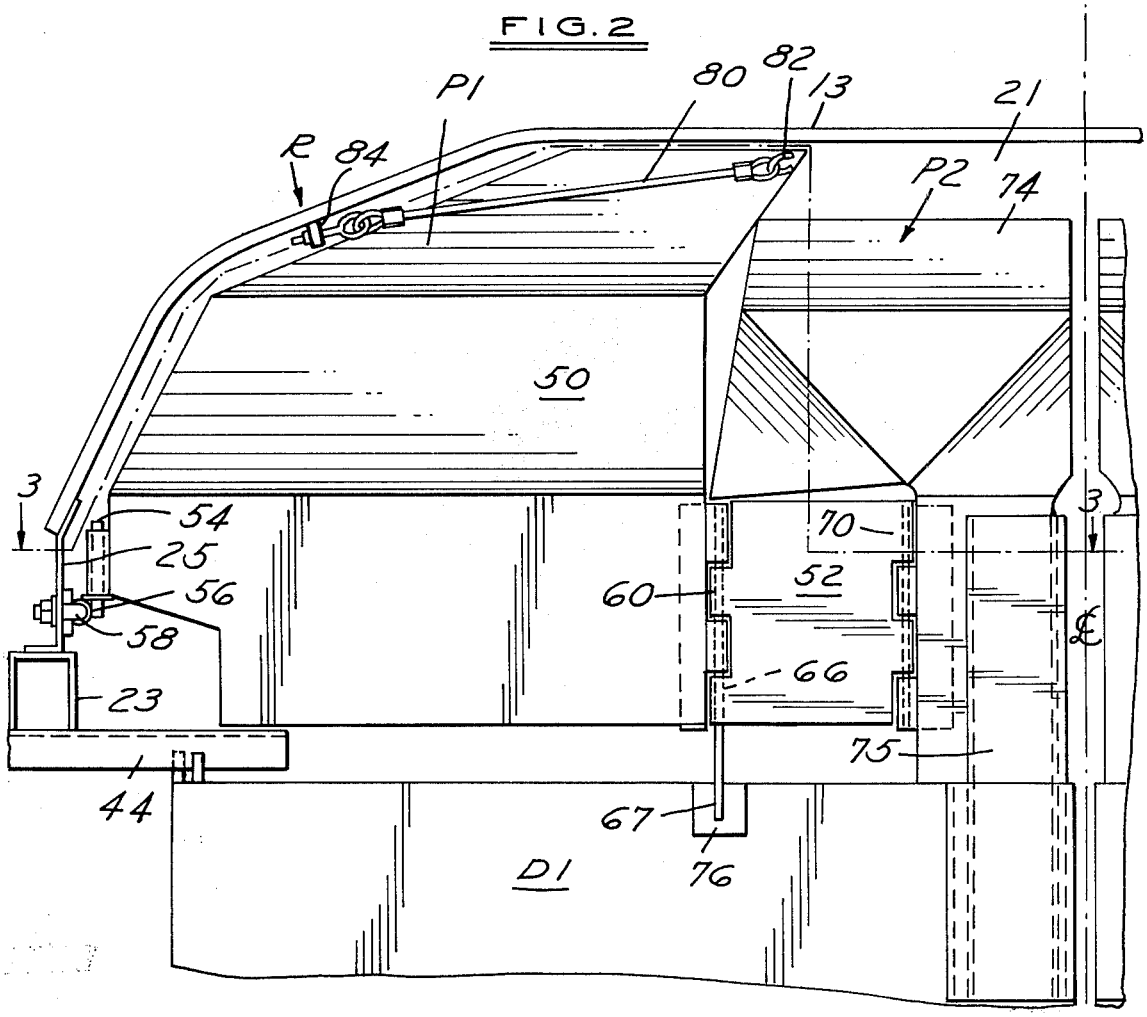
FIG. 2 is an enlarged fragmentary view of a portion of the structure shown in FIG. 1.

The inner edge portion of inner panel section 52 is hinged by a vertical hinge 70 to a member 74 which is rigidly secured to the inner edge portion of door D1 at the top thereof by strut 75. This member 74, being rigidly secured to door D1, may be considered part of the door, or because it closes a part of the upper portion 21 of the opening and is hinged to panel section 52, may be considered a part of the panel P1. Panel section 50 and member 74 slope upwardly and rearwardly as will be apparent in FIGS. 2 and 3.

Figure 3:
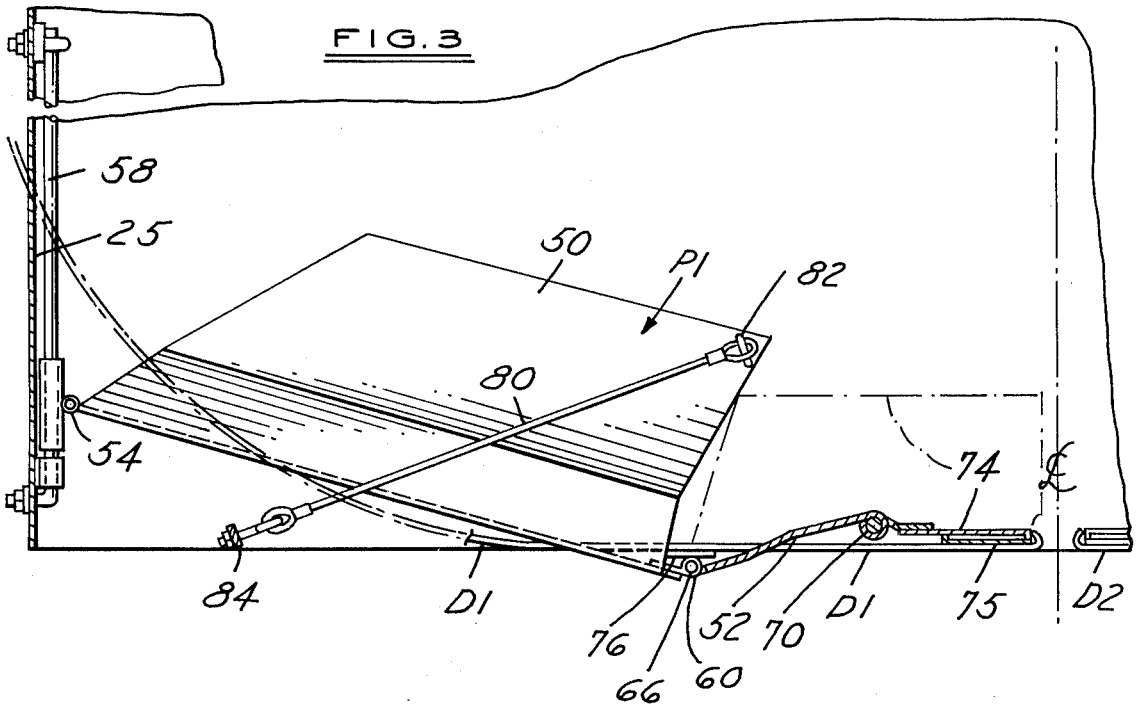
FIG. 3 is a sectional view taken on the line 3—3 of FIG. 2, showing a panel in closed position.
Figure 4:
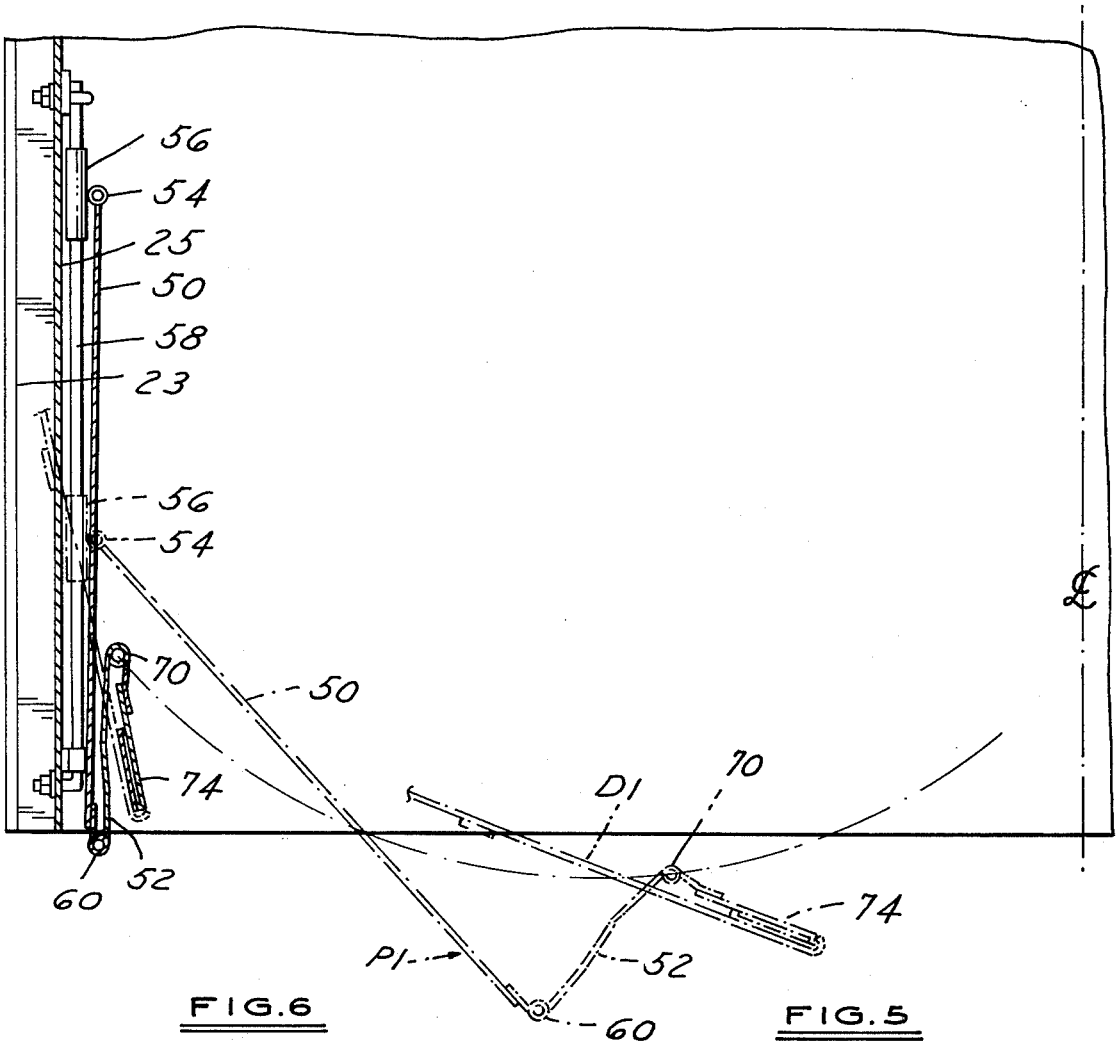
FIG. 4 is similar to FIG. 3, but shows the panel in open position in solid lines and in an intermediate position in dot-dash lines.

The panel P1 is shown in FIG. 3 in closed position in which position the panel sections 50 and 52 define an outward or forward fold away from the lading, and, to prevent the panel sections from folding inwardly, the hinge pin 66 has a downward extension 67 which engages a stop or wear plate 76 on the outer surface of the upper edge of the door when closed. When the panel P1 moves from closed position through intermediate to open position as shown in FIG. 4, the hinge 60 moves outwardly or forwardly with respect to the rail car so that the inner and outer sections 50 and 52 move away from the lading, which may be a stored vehicle, for example. In the fully open position, the sections of panel P1 are folded along the inner side of upper side wall section 25, substantially completely inside the rail car and with no portion thereof on the laterally outer side of the side wall.

The panels sometimes tend to vibrate when they are closed and the rail car is moving. In order to reduce or eliminate this tendency to vibrate, cables 80 may be employed. One end of a cable 80 is anchored to the upper, inner edge portion of each panel section 50 by a bracket 82 and the other end is anchored to the roof 13 by a bracket 84 at a point which is forwardly and laterally outwardly of the bracket 82 when the panel is closed. In this closed position of the panel, cable 80 is taut, holding the panel from vibrating and actually in some cases pulling the upper edge of panel section 50 upwardly and forwardly into engagement with the roof. The cable goes slack when the panel opens.

It will be more apparent that when either door D1 or D2 is moved from closed to open position, the panel above and connected to it will be moved by and simultaneously with the movement of that door to its open position. When open, the door projects through slot 19 and the laterally outer portion thereof will be disposed on the outer side of and close to the side wall, but within the allowed rail car side clearance. On the other hand, when the panel is open, it is folded inside the rail car, within the roof line thereof. When either door is moved from open to closed position, the panel above and connected to it will be moved by and simultaneously with the movement of that door to its closed position.

We claim:

1. An end closure for a rail car having a side wall, said end closure comprising an upright door and a panel, means mounting said door for lateral movement from a closed position across a lower portion of one end of said rail car to an open position adjacent said side wall, means mounting said panel above said door for lateral movement from a closed position across an upper portion of said end of said rail car to an open position disposed at the inner side of said side wall, and means connecting said panel to said door to cause said panel to be moved to open and closed positions by the corresponding movement of said door.

2. An end closure for a rail car having a side wall and means defining a vertical slot in said side wall near one end of said rail car, said end closure comprising an upright door and a panel, means mounting said door for lateral movement from a closed position across a lower portion of said one end of said rail car to an open position projecting through said vertical slot with at least a portion of said door disposed at the outer side of said side wall, means mounting said panel for lateral movement from a closed position across an upper portion of said one end of said rail car to an open position disposed at the inner side of said side wall, and means connecting said panel to said door to cause said panel to be moved to open and closed positions by the corresponding movement of said door.

3. An end closure as defined in claim 1 or 2, wherein said mounting means for said panel comprises means guiding the laterally outer edge portion of said panel for longitudinal movement along the inner side of said side wall, and said door is connected to said panel by said connecting means at the laterally inner edge portion of said panel.

4. An end closure as defined in claim 3, wherein said panel comprises a laterally outer section and a laterally inner section, and a hinge connecting the adjacent edges of said sections together in a longitudinally outware fold.

5. An end closure as defined in claim 4, including means for preventing said panel sections from folding inwardly.

6. An end closure as defined in claim 4, wherein said hinge has a portion engageable with a stop on said door in the closed positions of said panel and door to prevent said panel sections from folding inwardly.

7. An end closure as defined in claim 6, including means for reducing panel vibration during movement of the rail car.

8. An end closure as defined in claim 7, wherein said vibration reducing means comprises a cable attached to said panel and to the rail car, which is taut when the panel is closed and becomes slack when the panel is open.

* * * * *